United States Patent [19]

Ito et al.

[11] 4,050,691

[45] Sept. 27, 1977

[54] SEPARATOR DEVICE IN A COPYING MACHINE

[75] Inventors: Yoshio Ito, Yokohama; Masao Ariga, Koma; Masashi Suda, Irima, all of Japan

[73] Assignee: Canon Kabushiki Kaisha, Tokyo, Japan

[21] Appl. No.: 622,857

[22] Filed: Oct. 16, 1975

Related U.S. Application Data

[63] Continuation of Ser. No. 471,915, May 21, 1974, abandoned.

[30] Foreign Application Priority Data

May 28, 1973 Japan ..... 48-62692

[51] Int. Cl.[2] ..... B65H 29/56

[52] U.S. Cl. ..... 271/124; 271/DIG. 2

[58] Field of Search ..... 271/DIG. 2, 80, 174; 198/229; 355/3 R

[56] References Cited

U.S. PATENT DOCUMENTS

| | | | |
|---|---|---|---|
| 2,826,247 | 3/1958 | Katorsky | 198/229 |
| 3,578,859 | 5/1971 | Stillings | 271/DIG. 2 |
| 3,684,363 | 8/1972 | Ito et al. | 271/DIG. 2 |
| 3,770,345 | 11/1973 | Kawakubo et al. | 271/DIG. 2 |
| 3,811,670 | 5/1974 | Inoue | 271/DIG. 2X |
| 3,820,776 | 6/1974 | Fujimoto et al. | 271/80 |
| 3,912,256 | 10/1975 | Nagahara | 271/DIG. 2 |
| 3,914,041 | 10/1975 | Opravil | 271/DIG. 2 |
| 3,923,298 | 12/1975 | Ishida | 271/DIG. 2 |

*Primary Examiner*—Robert W. Saifer

*Attorney, Agent, or Firm*—Fitzpatrick, Cella, Harper & Scinto

[57] ABSTRACT

In a copying machine having a stripping pawl bearing against a photosensitive medium, a separator device comprises a pair of separator-conveyor rollers disposed immediately behind the stripping pawl adjacent one end of the photosensitive medium. The rollers are rotatable at a peripheral speed substantially equal to that of the photosensitive medium and adapted to hold therebetween a transfer medium which has been partly separated from the photosensitive medium by the stripping pawl and to guide the transfer medium away from the photosensitive medium.

4 Claims, 2 Drawing Figures

SEPARATOR DEVICE IN A COPYING MACHINE

This is a continuation of application Ser. No. 471,915, filed May 21, 1974 and now abandoned.

BACKGROUND OF THE INVENTION

1. Field of the Invention

This invention relates to a transfer medium separator device for automatically and positively separating a transfer medium from the surface of a photosensitive medium in an electrophotographic copying machine.

2. Description of the Prior Art

In the copying machines of the type which require image transfer, it has generally been the practice that an image corresponding to the original image of an object to be copied is formed and developed on the surface of a photosensitive medium, whereafter an ordinary transfer medium is brought into intimate contact with the surface of the photosensitive medium and concurrently therewith, corona discharge is applied from the back side of the transfer medium to electrostatically transfer the image from the photosensitive medium to the transfer medium. When this occurs, the transfer medium is kept in intimate contact with the surface of the photosensitive medium with the aid of the electrostatic attraction, and this makes it difficult for the transfer medium to be thereafter separated from the surface of the photosenitive medium. Conventional methods of separating such transfer medium include a blast of compressed air blown between the surface of the photosensitive medium and the transfer medium to accomplish the separation or a stripping pawl disposed adjacent the surface of the photosensitive medium.

However, the separating method employing the compressed air lacks in reliability and often effects erroneous separation, which in turn has led to wastage of transfer mediums. The method utilizing the separator pawl often fails to effect complete separation, depending on the precision of the relative position between the stripping pawl and the surface of the photosensitive medium.

SUMMARY OF THE INVENTION

It is therefore an object of the present invention to ensure separation of a transfer medium from a photosensitive medium.

It is another object of the present invention to provide a separator device which can automatically separate the transfer medium from the photosensitive medium.

It is still another object of the present invention to provide a separator device which can positively separate the transfer medium from the photosensitive medium.

It is yet another object of the present invention to provide a separator device which includes a separator pawl.

It is also an object of the present invention to provide a separator device which does not disturb the transferred image.

It is a further object of the present invention to provide a separator device which includes separator rollers.

According to the present invention, a transfer medium electrostatically attracted to the surface of the photosensitive medium is then caused to pass through a clearance between an auxiliary stripping roller and the photosensitive medium so as to strike against the blunt tip end of the stripping pawl, whereby the forward part of the transfer medium is warped or buckled and then released from the stripping pawl for further separation.

The transfer medium so partly separated from the photosensitive medium by the stripping pawl is then partly held between a set of separator-conveyor rollers disposed just behind the stripping pawl, whereby the transfer medium may be positively separated.

The invention will become fully apparent from the following detailed description of an embodiment thereof taken in conjuction with the accompanying drawings.

DESCRIPTION OF THE PREFERRED EMBODIMENT

Figure 1:
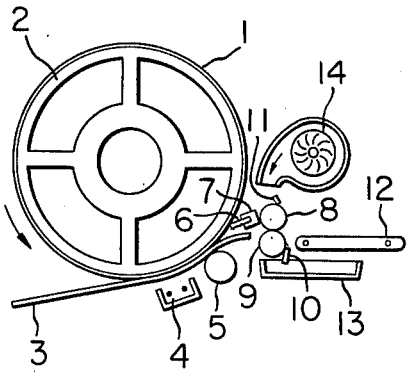
FIG. 1 is a cross-sectional view showing an embodiment of the present invention.
Figure 2:
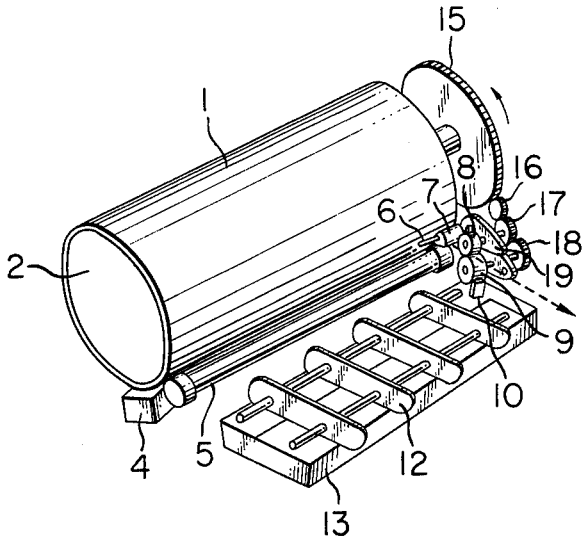
FIG. 2 is a perspective view of the same embodiment.

Referring to the drawings, reference numeral 1 designates a three-layer photosensitive medium of photoconductivity mounted around a rotatable drum 2, and reference numerals 3 and 4 designate a sheet of paper or like transfer medium and a transfer electrode for corona discharging, respectively. An auxiliary stripping roller 5 is provided adjacent the drum 2 and has a length substantially equal to that of the drum 2 for the photosensitive medium. The roller 5 is rotatable at a peripheral speed equal to that of the photosensitive medium. A separator pawl 6 is fixedly mounted on a supporting portion 7, which in turn is secured to a frame 19, and the blunt tip end of the separator pawl 6 is in contact with the surface of the photosensitive medium 1.

Rollers 8 and 9 are rotatably journalled in bearings of the frame 19 and rotated by the rotating drum 2 through a gearing mechanism comprising a gear 15 integral with the drum, idler gear 16 and gears 17 and 18. The peripheral speed of each of the pair of rollers 8 and 9 is equal to that of the surface of the photosensitive medium. Blade cleaners 10 and 11 bear against the rollers 8 and 9, respectively, so as to clean these two rollers at all times. A guide 12 is provided to guide the transfer medium 3 after separation. A container 13 is provided to store therein the slight amount of toner falling from the rollers. Silocco fan or crossed fan 14 provides auxiliary guide means for positively guiding the separated transfer medium 3 to the guide 12.

In the present embodiment, the transfer medium 3 of FIG. 1 is delivered to the surface of the photosnesitive medium 1 with the image thereon already developed, whereafter it is subjected to the corona discharge from the transfer electrode 4 and the toner image on the photosensitive medium 1 is transferred to the transfer medium. After completion of the image transfer, the transfer medium 3 remains electrostatically attracted to the surface of the photosensitive medium 1 as it is moved in the direction of the arrow with the rotation of the drum 2, so that the transfer medium passes through the clearance between the auxiliary stripping roller 5 and the photosensitive medium 1 to strike against the blunt tip end of the separator pawl 6, by which the leading edge of the transfer medium 3 is buckled or wraped and then released so as to clear the stripping pawl 6 and pass into the nip between the pair of rollers 8 and 9. Thereafter, the transfer medium is nipped between these rollers 8 and 9 and advanced onto the guide member 12 for separation from the photosensitive medium under the rotational force thereof. The breeze from the fan 14 ensures greater reliability of such movement of the transfer medium. The separator pawl 6 may preferably be formed of urethane or like material, and its pressure against the surface of the photosensitive medium may preferably be up to the order of 10g/mm. The blade cleaners 10 and 11 for the rollers 8 and 9 may also be formed of urethane rubber or like elastic material. In order to prevent the copy image from being injured at the roller portion, drive is transmitted individually to each of the pair of rollers 8 and 9 so as to prevent slip thereof with respect to the transfer medium, and the blade cleaners 10 and 11 are urged against the respective rollers to clean the surfaces of these rollers at all times to remove the toner therefrom. The rollers are formed of a metallic material coated with Teflon, Delrin or chromium plating so as to provide a sufficient surface smoothness to preclude the toner from depositing thereon.

Also, in order to protect the stripping pawl and objects in its vicinity against contamination, such a design may be made that utilizes the breeze from the fan 14 to collect those slight amounts of falling toner, whereby the area of the transfer medium nipped between the rollers may be protected against reduced quality of the copy image.

Such construction of the present invention accomplishes positive separation of the transfer medium without interfering with the image transfer, and thus achieves a highly reliable and practical effect.

We claim:

1. A separator device in a transfer type copying machine for separating a transfer material from a surface of a rotating drum type photosensitive member after a visualized image on the surface of the photosensitive member has been transferred to the transfer material at an image transfer station, said separator device comprising:

a single stripping pawl having a blunt end which is stationary and which contacts an end portion of the surface of the photosensitive member at a position immediately after the transfer station, wherein said pawl contacts a leading end of the transfer material to cause a portion of the transfer material adjacent said leading end to buckle and subsequently curl away from said stripping pawl, thereby stripping said portion of the transfer material away from the surface of the photosensitive member;

a pair of separating rollers disposed immediately downstream of said stripping pawl with respect to the direction of movement of the transfer material, for gripping the leading end of the transfer material after said curling movement thereof away from said pawl, said rollers rotating at the same peripheral speed as of the photosensitive member; and means for cleaning peripheral surfaces of said rollers to remove unfixed toner deposited thereon.

2. A separator device in accordance with claim 1, wherein said pair of rollers are coated with Teflon.

3. A separator device in accordance with claim 1, further comprising auxiliary separating roller means mounted adjacent the photosensitive member for stabilizing the transfer medium as it is separated from the photosensitive medium.

4. A separator device in accordance with claim 1, further comprising auxiliary means for directing an air flow toward the contact position between said stripping pawl and said photosensitive member for guiding said partly stripped transfer medium to said pair of separating rollers.

* * * * *